US007331487B2

(12) United States Patent
Macler, II et al.

(10) Patent No.: US 7,331,487 B2
(45) Date of Patent: Feb. 19, 2008

(54) OFFICE WATER COOLER ADAPTER FOR USE WITH BAGGED FLUIDS

(75) Inventors: Henry H. Macler, II, Monroe, LA (US); Jeffrey E. Macler, Tecumseh, MO (US); Steven Avery, South Jordan, UT (US)

(73) Assignee: AMMM Patent Holdings, LLC, Tecumseh, MO (US)

( * ) Notice: Subject to any disclaimer, the term of this patent is extended or adjusted under 35 U.S.C. 154(b) by 177 days.

(21) Appl. No.: 10/940,057

(22) Filed: Sep. 13, 2004

(65) Prior Publication Data

US 2005/0092769 A1 May 5, 2005

Related U.S. Application Data

(60) Provisional application No. 60/502,723, filed on Sep. 12, 2003, provisional application No. 60/545,155, filed on Feb. 17, 2004.

(51) Int. Cl.
*B67D 5/62* (2006.01)
*B65D 35/56* (2006.01)

(52) U.S. Cl. ..... 222/83; 222/105; 222/146.1; 222/185.1; 222/481.5

(58) Field of Classification Search ..... 222/81, 222/83, 83.5, 105, 146.1, 146.6, 185.1, 481.5
See application file for complete search history.

(56) References Cited

U.S. PATENT DOCUMENTS 1,316,122 A 9/1919 Vall
1,364,889 A 1/1921 Rupp
1,889,557 A 4/1932 Lange
2,655,286 A 10/1953 Barbaro
3,239,104 A 3/1966 Scholle
3,435,990 A 4/1969 Pike, Jr.
3,587,934 A 6/1971 Elmore et al.
3,688,950 A 9/1972 Parish
3,813,009 A 5/1974 Lenz
3,848,776 A 11/1974 Schiesser
4,008,832 A 2/1977 Rodth
4,293,081 A 10/1981 Kuckens
4,527,716 A 7/1985 Hass et al.
4,561,560 A 12/1985 Lyon
4,755,292 A 7/1988 Merriam
4,793,514 A * 12/1988 Sheets ..... 222/67
4,801,007 A 1/1989 Rule (Continued)

FOREIGN PATENT DOCUMENTS

CA 1 229 073 8/1985

(Continued)

*Primary Examiner*—Joseph A. Kaufman
(74) *Attorney, Agent, or Firm*—Lewis, Rice & Fingersh, L.C.

(57) ABSTRACT

A fluid dispensing apparatus comprises a collapsible bag capable of being punctured by and essentially sealed about a spike that has an inlet through which fluid can flow from the bag into a conduit leading to a chamber that is situated within an enclosed chamber in a dispensing base unit. The chamber is connected to a valve positioned outside the enclosed chamber through which fluid can be dispensed from the chamber. The enclosed chamber is vented so that as fluid is dispensed from the chamber, the air pressure in the enclosed chamber is allowed to equalize with the ambient air pressure external to the chamber and the bag.

20 Claims, 6 Drawing Sheets

U.S. PATENT DOCUMENTS

| | | | | | |
|---|---|---|---|---|---|
| 4,846,236 | A | | 7/1989 | Deruntz | |
| 4,865,218 | A | | 9/1989 | Derby et al. | |
| 4,881,662 | A | * | 11/1989 | Tallman | 222/81 |
| 4,911,334 | A | * | 3/1990 | Kedzierski | 222/131 |
| 4,923,091 | A | * | 5/1990 | Sutera | 222/67 |
| 5,111,966 | A | | 5/1992 | Fridman | |
| 5,141,134 | A | | 8/1992 | Machado | |
| 5,224,619 | A | | 7/1993 | Dilworth et al. | |
| 5,281,027 | A | | 1/1994 | Thrall | |
| 5,402,915 | A | * | 4/1995 | Hogan | 222/105 |
| 5,405,053 | A | | 4/1995 | Zublin | |
| D361,838 | S | | 8/1995 | Kuhn et al. | |
| 5,526,961 | A | * | 6/1996 | Burrows | 222/185.1 |
| 5,551,606 | A | | 9/1996 | Rai et al. | |
| 5,567,322 | A | | 10/1996 | Rundle et al. | |
| 5,573,047 | A | | 11/1996 | Akin | |
| 5,645,913 | A | | 7/1997 | Rogers | |
| 5,691,015 | A | | 11/1997 | Tsukamoto et al. | |
| 5,944,232 | A | | 8/1999 | Hestehave et al. | |
| 5,967,197 | A | | 10/1999 | Shown | |
| 6,026,988 | A | | 2/2000 | Teetsel, III et al. | |
| 6,095,433 | A | | 8/2000 | Langdon | |
| 6,098,844 | A | * | 8/2000 | Nicolle | 222/80 |
| 6,116,467 | A | | 9/2000 | Petriekis | |
| 6,149,034 | A | | 11/2000 | Amberg et al. | |
| 6,207,046 | B1 | | 3/2001 | Yamashita et al. | |
| 6,223,940 | B1 | | 5/2001 | Quinn | |
| 6,398,073 | B1 | | 6/2002 | Nicolle | |
| 6,442,960 | B1 | | 9/2002 | Fournier et al. | |
| 6,557,735 | B1 | | 5/2003 | Stray | |
| 6,726,061 | B2 | | 4/2004 | Good | |

FOREIGN PATENT DOCUMENTS

| | | |
|---|---|---|
| CA | 1 192 164 | 11/1987 |
| CA | 1229073 | 11/1987 |
| CN | 98213085.6 | 6/1999 |
| CN | 98215283.3 | 7/1999 |
| CN | 99209220.5 | 4/2000 |
| CN | 99246066.2 | 9/2000 |
| CN | 99246067.0 | 9/2000 |
| CN | 99254569.2 | 2/2001 |
| CN | 00237624.5 | 5/2001 |
| CN | 00237625.3 | 7/2001 |
| CN | 03209721.2 | 8/2004 |
| CN | 03231908.8 | 8/2004 |
| CN | 03231906.1 | 9/2004 |
| CN | 03210115.5 | 10/2004 |
| CN | 200320100534.9 | 3/2005 |
| CN | 200410052994.8 | 3/2005 |
| CN | 200410067280.4 | 3/2005 |
| CN | 200420005755.2 | 3/2005 |
| CN | 200420037745.7 | 7/2005 |
| CN | 200420107401.9 | 11/2005 |
| EP | 0250640 | 1/1988 |
| FR | 2685293 | 6/1993 |

* cited by examiner

OFFICE WATER COOLER ADAPTER FOR USE WITH BAGGED FLUIDS

CROSS REFERENCE TO RELATED APPLICATIONS

This application claims the benefit of U.S. Provisional Patent Applications Nos. 60/502,723, filed Sep. 12, 2003, and 60/545,155, filed Feb. 17, 2004, the entire disclosures of which are herein incorporated by reference.

BACKGROUND OF THE INVENTION

1. Field of Invention

The present invention relates to a system for dispensing fluids. In particular, the present invention relates to a fluid dispensing system wherein a support structure holds bulk fluid that is transferred to an enclosed chamber in a dispensing base from which chamber the fluid is dispensed. After dispensing air pressure in the enclosed chamber is equalized with the air pressure acting on the bulk fluid.

2. Description of Related Art

Conventional domestic fluid dispensers used primarily for providing heated or cooled water are usually free standing devices which dispense sterilized or mineral water from large rigid water bottles. The rigid water bottles have a large body portion and a narrow neck portion having a mouth opening, and are coupled to the water dispenser by inverting the bottle and positioning the mouth of the bottle in the chamber of the water dispenser. Air, introduced into the water bottle through the mouth, allows water to be dispensed from the inverted bottle until the water level in the chamber reaches the mouth of the bottle. Since the water bottle is rigid, once the water level in the chamber reaches the mouth of the bottle no more air can enter the bottle, so water remaining in the inverted bottle is retained in the bottle due to the difference between the air pressure external to the inverted bottle and the air pressure inside the bottle. Water is then dispensed from the chamber through a conduit attached to a valve at the opposite end from the chamber. When the level of water in the chamber falls below the mouth of the water bottle, air enters the water bottle, allowing water to flow from the bottle until the water level in the chamber again reaches the mouth of the bottle.

Although conventional domestic water dispensers are widely used, they are deficient in a number of respects. First water bottles used in the conventional domestic water dispenser usually contain a large quantity of sterilized water, typically on the order of about 5 gallons. Due to the weight and size of a bottle holding that amount of water, it is often difficult to invert and properly locate the mouth of the bottle in the chamber without spilling a quantity of the water.

Second, to prevent water from continuously flowing from the water bottle while the water bottle is inverted, the water bottles used with such water dispensers are fabricated from a thick, rigid, plastic material that can hold a vacuum without collapsing. Due to their cost, the water bottles are usually resterilized and reused after an initial use. As a result, the cost of shipping the empty water bottle back to the supplier for sterilization and reuse are adsorbed by the consumer through increased water costs.

Third, in order for the mouth of the water bottle to be positioned in the chamber of the cooler, the water bottles must have a neck, as described above. The presence of the neck, however, increases the difficulty in sterilizing the water bottles, since the neck may limit the ability of the sterilizing agents to reach all the interior parts of the bottle, even when large quantities of sterilizing agents are used. While the use of heat sterilization may overcome this problem to some extent, it is generally not possible to use heat sterilization on plastic bottles. Although, sterilization using ultraviolet light is possible, ultraviolet light sterilization may lead to an incomplete result. Particularly troublesome, once the bottle is inverted into the fluid dispenser, the outside of the neck of the bottle contacts the fluid, and it is very difficult to maintain this area of the bottle sterile.

Fourth, with the necessity of sterilizing the water bottles after each use, over time the rigid plastic water bottles may develop cracks or holes. If such failures occur while the water bottle is inverted in the water dispenser, air will enter the water bottle and allow water to flow uncontrollably from the mouth of the water bottle, allowing the chamber to eventually over flow. This water over flow can expose the purchaser's premises to the risk of water damage.

One solution to the problem of potential chamber overflow, and the necessity to make bottles of rigid materials to allow for the pressure differential described above, is to add a valve in the flow path between the bottle and the chamber. Such a valve allows the flow of water out of the bottle to be closed off so that the chamber does not overflow, thus eliminating the necessity of a rigid bottle and eliminating. Such a valve can operate automatically, opening and closing depending on the level of the fluid in the chamber.

Aided by the use of valves in the path between the bottle and the chamber, a more recent development in fluid dispensing systems has been to utilize bags rather than bottles to transport and dispense water from an otherwise conventional fluid dispensing system ("office cooler"). Such a system is described in U.S. Pat. No. 6,398,073 ('073) to Nicole, for example, which is incorporated herein by reference. The '073 patent offers a device that dispenses fluid from a disposable or recyclable bag, and thereby affords some of the benefits associated therewith. As described in the '073 patent, however, to overcome the problem of over flowing the chamber since a collapsible bag cannot hold a reduced pressure headspace (as a rigid bottle does), the device described therein requires a valve to control flow between the bag and the chamber.

An embodiment of the '073 fluid dispensing system uses fluid contained in a bag to fill a chamber from which fluid can be dispensed, and preferably uses a ballcock valve to control the flow of water from the bag into the chamber. The carrier is disposed on top of a water cooler housing and, together with a fluid filled bag positioned therein, is designed to be used as a replacement for the conventional, inverted, rigid, plastic water bottle. A spike is provided in the carrier for puncturing the bag after the bag is positioned therein. The spike includes an internal fluid passage that extends through the carrier to allow the fluid to flow from the bag, through a conduit, and into the chamber. The conduit includes the flow control valve, which allows fluid to flow from the bag into the chamber under the force of gravity when the level of fluid in the chamber drops below a desired level, and terminates the fluid flow from the bag when the level of fluid in the chamber reaches the desired level. After fluid is dispensed from the chamber through an access tap, fluid from the bag will refill the chamber to the desired level, as controlled by the valve.

SUMMARY OF EMBODIMENTS OF THE INVENTION

In light of the prior art and the problems thereof, the fluid dispensing system described herein comprises a support that is preferably used for supporting a collapsible bag containing fluid, the support being designed to be positioned adjacent to a fluid dispensing base. A spike connected to either the support or the dispensing base projects in a direction to enable the spike to puncture a bag containing fluid supported by the support. A fluid passage is provided in the spike to allow fluid to pass from the bag into an enclosed chamber in the dispensing base. The enclosed chamber is connected to the ambient space external to the bag only through a vent channel. In operation, once the bag is spiked, fluid flows from the bag into the chamber until the fluid level in the chamber rises to the level of the vent channel opening and then rises further until the fluid level in the vent channel matches the level of the fluid in the bag. After water is dispensed from the chamber, the chamber is refilled with fluid from the bag. Fluid flow from the bag stops when fluid rises in the vent to a level that matches the level of fluid in the bag, or when the bag is empty. When the supply of water in the bag is exhausted, the bag can be removed from the support and replaced with another sealed bag of fluid.

In an embodiment a fluid dispensing system comprises a dispensing base; an enclosed chamber positioned interior to the base; a support external to the dispensing base, the support providing support for a bag containing fluid; a fluid passage allowing the fluid in the bag to flow into the enclosed chamber; a vent connecting the enclosed chamber to a space external to the enclosed chamber; and a dispensing valve connected to the enclosed chamber allowing for dispensing from the enclosed chamber. When the dispensing valve is closed, the fluid in the bag will flow through the fluid passage into the enclosed chamber and into the vent, until the fluid level in the vent is the same as the fluid level in the bag. The support may be fabricated from a plastic resin material. The fluid passage may further comprise a spike, which in an embodiment may be positioned in the support adjacent a point of local elevation minimum thereof. The spike may comprise a conical tip having at least one fluid inlet positioned on the tip, and may further comprise a shaft having at least one generally perpendicularly projecting wing flair. Such a wing flair generally connects to the shaft of the spike along a length of the circumference thereof that is less than the length of the entire circumference. The chamber may include a means for altering, such as reducing or elevating, the temperature of the fluid contained therein.

In an alternate embodiment, the fluid dispensing system further comprises a bag containing fluid supported by the support and essentially sealed about the spike, the spike having punctured a wall of the bag. The bag may be fabricated from a single-layer polyethylene sheet. A protective outer layer enclosing the bag may be removed from about the bag prior to the spike puncturing the bag.

In an alternate embodiment, the maximum volume rate of fluid flow through the vent into the chamber is limited to a value less than the maximum net volume rate of fluid flow out of the chamber through the dispensing valve taking into account the maximum volume rate of fluid flow through the fluid passage from the bag into the chamber, so that as fluid is dispensed out from the chamber through the valve at the maximum net volume rate of flow, the pressure in the chamber is reduced below the pressure external to the fluid dispensing system at the location of the end of the vent opposite from the end of the vent located in the chamber.

In a still further alternate embodiment a fluid dispensing system for dispensing fluid from a collapsible bag, comprises a support capable of supporting the collapsible bag during dispensing of fluid from the bag and having a supporting surface with a point that can be oriented as a local minimum in elevation, the supporting surface defining two spaces, a first space adjacent to a first side of the supporting surface, and a second space on a second side of the supporting surface, opposite the first side; a spike connected to the support projecting essentially from the point of local elevation minimum and projecting into the first space, the spike including a fluid inlet on the exterior surface of the spike, the fluid inlet being connected to a passage internal to the spike through which fluid can flow after passing through the inlet, the passage connecting the first space to the second space on the opposite side of the support surface; and a vent connecting the first space to the second space through which the fluid can pass; wherein when the fluid dispensing system is in use, the first space is sealed from the second space such that the first space and the second space are in fluid communication only through spike and vent connections. In an embodiment of such a system, the vent is dimensioned so that no portion of the fluid is entrained within the vent as a result of the surface tension of the fluid. In an embodiment of such a system, the spike projects into the collapsible bag in the first space providing access for the fluid in the bag to the second side of the support surface. In an embodiment of such a system, the second space, the spike, and the vent are dimensioned so that when the collapsible bag is punctured by the spike, any increase in pressure in the second space resulting therefrom is absorbed by compressible gasses in the second space and in the vent, and does not result in fluid being ejected from the vent into the first space.

DESCRIPTION OF PREFERRED EMBODIMENTS

Figure 1:
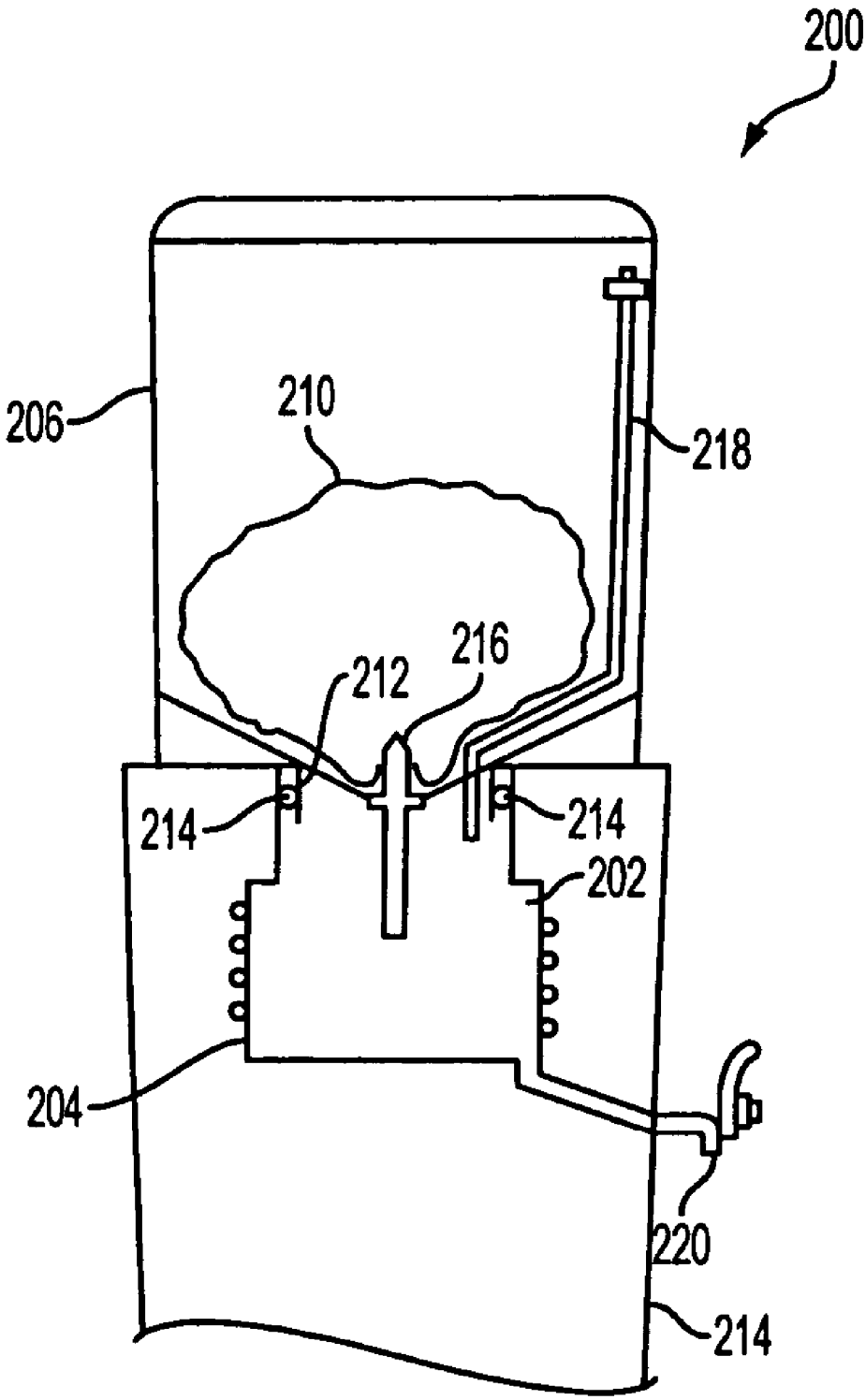
FIG. 1 is a cross-sectional view of an embodiment of a fluid dispensing system of the present invention utilizing a vent for equalization of air pressure on the fluid in the chamber and the fluid above the spike inlet.

Turning now to FIG. 1, a fluid dispensing system 200 in accordance with a preferred embodiment of the invention is shown which can be used to dispense fluid from a collapsible bag 210. This embodiment comprises an enclosed chamber 202 into which fluid from a collapsible bag 210 can flow, and from which fluid can be dispensed from a tap 220. A support 206 rests on top of a dispensing base 208 and is used to support the bag 210. In an embodiment in which the support 206 is capable of holding a fluid, the fluid dispensing system 200 can operate to dispense a fluid that has been placed directly into the support 206; however, a preferred method to supply fluid to the fluid dispensing system 200 is through use of a sealed bag 210 containing fluid. When the fluid is contained in a sealed bag 210 there are significant advantages in terms of maintaining the quality of the fluid. Additionally, when the fluid is supplied in a sealed bag 210 the support 206, itself, need not be constructed to contain the fluid, but need only support the bag 210 containing the fluid. In an embodiment using the support 206 to support a bag of fluid rather than actually to contain fluid, there is significant latitude in the design of the support 206.

In the embodiment shown in FIG. 1, the support 206 has a collar 212 that extends into the chamber 202. A gasket 214, such as a malleable o-ring, circumscribes and is connected to the collar 212 and fits snuggly against a wall of the chamber 202. In an alternate embodiment the gasket 214 is connected to and generally fixed in place with respect to the chamber 202. In either case, when the support 206 is positioned adjacent to the cooler base 208, the collar extends into the chamber 202 and the gasket 214 fits snuggly between the chamber 202 and the collar 212 forming an airtight seal. It should be understood that the purpose of the gasket as shown is to enclose the chamber 202 and that more complex systems can be designed to achieve the same effect. For example, in an embodiment where the chamber 202 is separable from the cooler base 208, both the chamber 202 and the support 206 are sealed with separate gaskets to the cooler base 208.

In the embodiment shown in FIG. 1, placement of the support 206 onto the cooler base 208 with the collar 212 extending into the cooler base 208, as is shown in FIG. 1, creates an air tight seal between the support 206 and the cooler base 208 as a result of the snug fit created by the gasket 214. Placement of the support 206 onto the cooler base 208 as shown in FIG. 1 encloses the chamber 202, and separates the air space of the chamber 202 from the ambient air space external to the support 206 and external to the cooler base 208. Once the chamber 202 is so enclosed, fluid (including air or water) communication between the two air spaces, i.e, inside and outside the chamber 202, is only possible through either one of the spike 216 and the vent 218.

In an embodiment, the combined weight of the fluid and the bag containing the fluid is sufficient to cause the spike to puncture the bag once a sealed bag 210 of fluid is placed on the support 206 and on the spike 216. In alternate embodiments, it may be necessary to exert an additional force on the bag 210 or the spike in order to enable the spike 216 to puncture the bag 210. In an example, such an additional force may be exerted on the bag 210 on a side of the bag 210 generally opposite the spike 216. In another example, a spike 206 that is movable relative to the cooler base 208 may be forced against the bag 210 by any of various mechanisms, including a spring compressed against the cooler base 208. In a preferred embodiment, the additional force is obtained by dropping the bag 210 onto the spike 216 from a height of about six inches. In various alternative embodiments the height from which the bag 210 is dropped onto the spike 216 may vary significantly, and may be as great as several feet.

The bag 210 and spike 216 are preferably constructed so that the bag 210 will seal about the spike 216 after the bag 210 is punctured. Such a seal may be dependent upon the materials and dimensions of both of the bag 210 and the spike 216. The preferred materials and dimensions for producing such a seal is described in the U.S. patent application Ser. No. 10/926,604, titled Portable Water Cooler for use with Bagged Fluids and Bagged Fluids for use Therewith, filed on Aug. 25, 2004, which application is herein incorporated by reference in its entirety.

In a preferred embodiment, the bag 210 comprises a sealed, flexible bag 210 as illustrated in FIG. 1. Fluid in a bag 210 may be referred to herein as "bagged fluid". The bag 210 may be made of any suitable material, but is preferably made of a plastic material such as an organic polymer sheet material and is preferably flexible and pliable and does not impart a rigid shape to the fluid. The bag 210 may, however, be filled with fluid to a point that the fluid is under pressure, forming a relatively inflexible combination when the bag is sealed. The bag 210 also may be of any suitable construction. Preferably the bag 210 placed in the cooler comprises a single-layer film wall. In an alternate embodiment a bag 210 may be constructed with several plies of material or a set of bags placed one within another. Such a multi-layer bag system may include what is commonly referred to in the art as a secondary containment or an overwrap. For a bag 210 having several layers, one or more of the layers may be removed prior to placing the bag 210 in the portable water cooler (101).

In a preferred embodiment, the interaction of the bag 210 and the spike 216 is such that after the bag 210 is pierced, the opening in the bag 210 seals around the spike 216, thus preventing leakage of any significant amount of fluid from inside the bag 210 onto the support 206. Sealing of the bag 210 about the spike 216 is accomplished when the shaft 608 is sized and shaped so that as the wall of the bag 210 is deformed and broken by the tip 606 the integrity of the wall of the bag 210 remains intact around the entire circumference of the spike 216. Generally, the integrity of the bag 210 will remain intact up to the point of contact between the bag 210 and the spike 216, as well as for some length along the spike 216 in a direction generally perpendicular to the circumference thereof (e.g., a cuff). In an embodiment, the physical properties of the bag material (e.g., elasticity) promote the sealing of the bag 210 about the spike 216.

Figure 5:
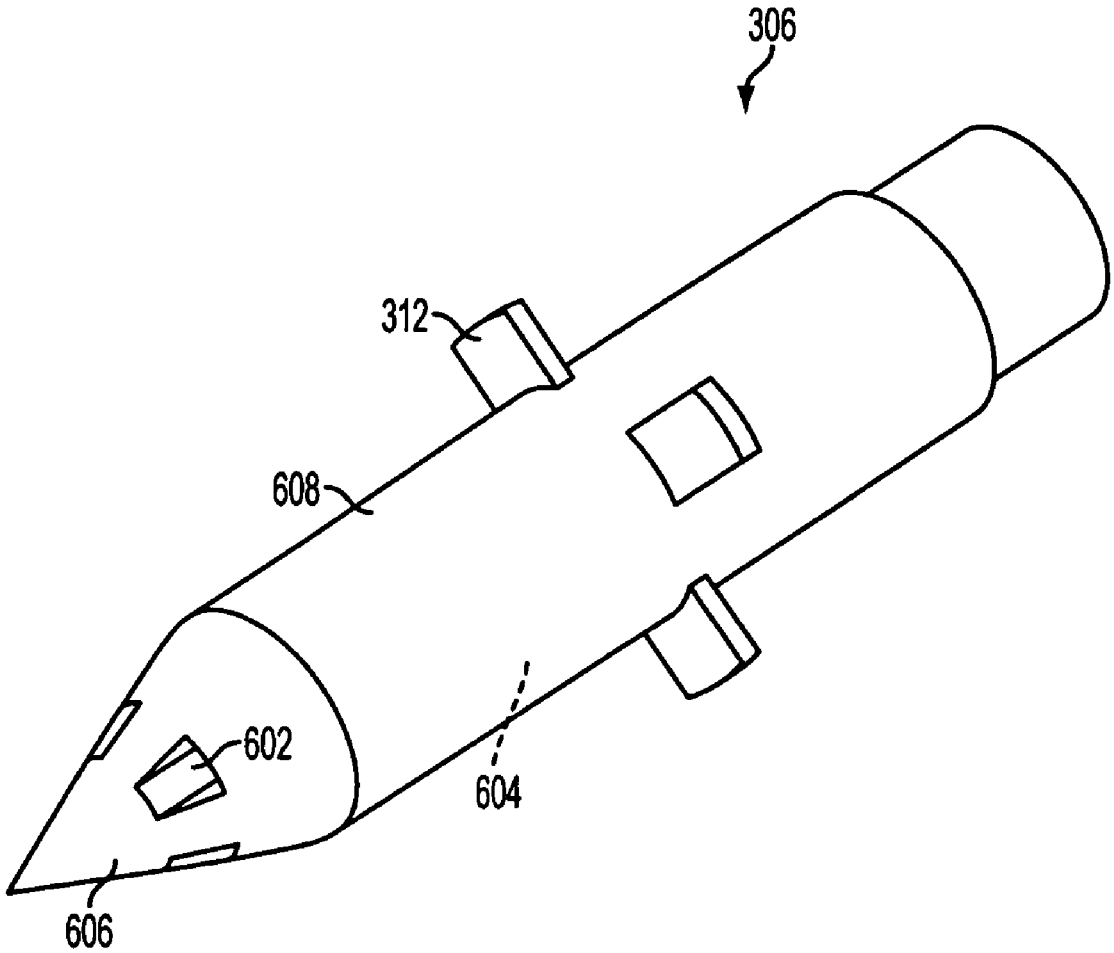
FIG. 5 is a perspective view of the spike shown in FIG. 2.

In an embodiment such as shown in FIG. 5, the spike 306 includes a cylindrical shaft 608 and a conical tip 606 that comprises a circular cone positioned at an end of the shaft 608 and having a radius at its base identical to, or slightly smaller than, the largest radius of the shaft 608. In this configuration, as the bag material is punctured by the point of the cone, the opening in the bag 210 is gradually enlarged as the bag 210 is pushed over the cone of the conical tip 606 and onto the shaft 608. During this puncturing process, the wall of the bag 210 may tend, in effect, to roll inward and upward along the conical tip 606 and the shaft 608, thus creating a cuff of bag material that rests along a length of the spike 216 all the way around the circumference of the spike 216. Having been forced onto the shaft 608, the opening in the bag 210 is sealed against the shaft 608, the opening in the bag essentially exactly matching the shape and circumference of the shaft 608. To an extent, the seal is aided by pressure exerted by the fluid, tending to push the cuff of the bag against the spike 216.

The exact size and shape of the cone and shaft useful for forming a seal for preventing or sufficiently hindering leaks depends on many factors, including the dimensions of the bag 210, the materials used in the bag's construction, and the type and amount of fluid contained therein, among others. While other sets of parameters also may work well, a set of spike and bag parameters that is particularly well suited to use in an embodiment includes the following: a bag preferably made from a single sheet of polyethylene having a sheet thickness in the range of 1 to 10 mil, preferably from about 3 to about 4 mil, the bag preferably being rectangular in shape and having planar dimensions in the range of about 12-16 inches by about 14-18 inches, most preferably about 14.6 by about 16.6 inches, the bag filled with about 2.4 to about 3 gallons of fluid, preferably with about 2.7 gallons, and sealed with no more than about 100-500 milliliters of air, preferably no more than about 300 milliliters, and a spike having a smooth but unpolished outer surface, having an outer diameter and height no less than about 0.37 inch, preferably having a height and outer diameter in the range of about 0.5-0.7 inch, the spike topped by a blade that is preferably a right circular cone having an angle of expansion in the range of about 30-60 degrees, and more preferably about 35-45 degrees. The angle of expansion as used herein being the angle between two lines lying along the outer surface of the cone and passing through the vertex of the cone, the two lines being opposite sides of an isosceles triangle the base of which is a diameter of the circular base of the cone. Given a spike 216 and bag 210 as just described, the puncturing and subsequent sealing of the bag by the spike 216 is easily accomplished by dropping the bag 210 onto the spike 216 from a height of about six inches.

Generally, for a conical tip 606 as described above, the cuff of a single sheet polyethylene bag will have a length (height) that is fairly constant around the circumference of the shaft 608, and that is about equal to the radius (half the diameter) of the cylindrical shaft 608, since the blade is symmetrical. For a spike 216 with a conical tip 606 and cylindrical shaft 608 and a 3 to 4 mil single sheet polyethylene bag, a cuff of less than about one-quarter inch does not seal as well as do larger cuffs. In this regard, bags (301) made of laminate constructions generally do not seal as well as non-laminate constructions because of the likelihood of unsymmetrical cuffs, and in particular, the possibility of crack propagation along a length generally perpendicular to the spike 216, which may compromise the integrity of the wall of the bag 210 a distance away from the spike 216 and allow leakage.

Figure 2:
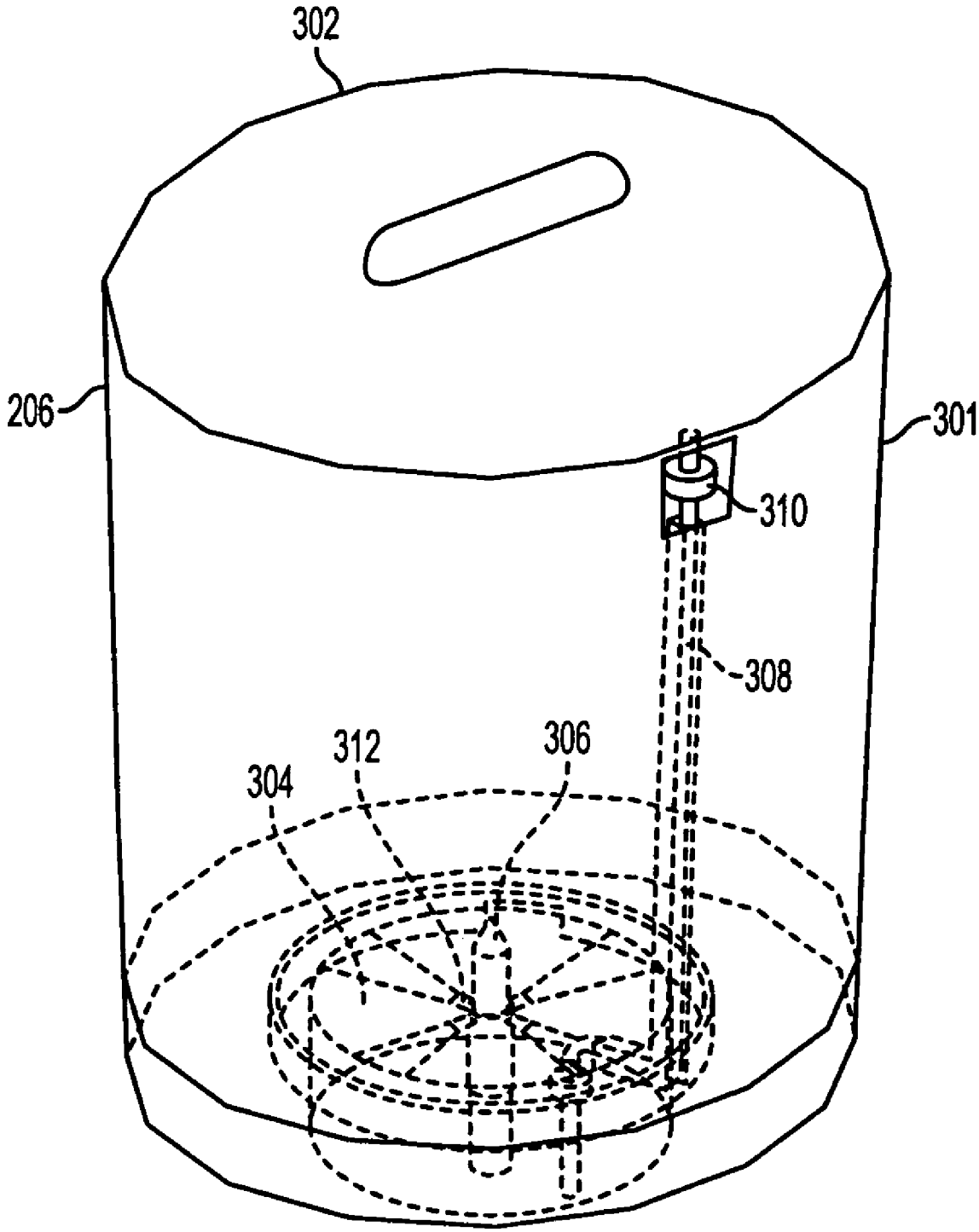
FIG. 2 is a perspective view of an embodiment of the support for supporting a bag containing fluid, and also shows a spike and vent.
Figure 3:
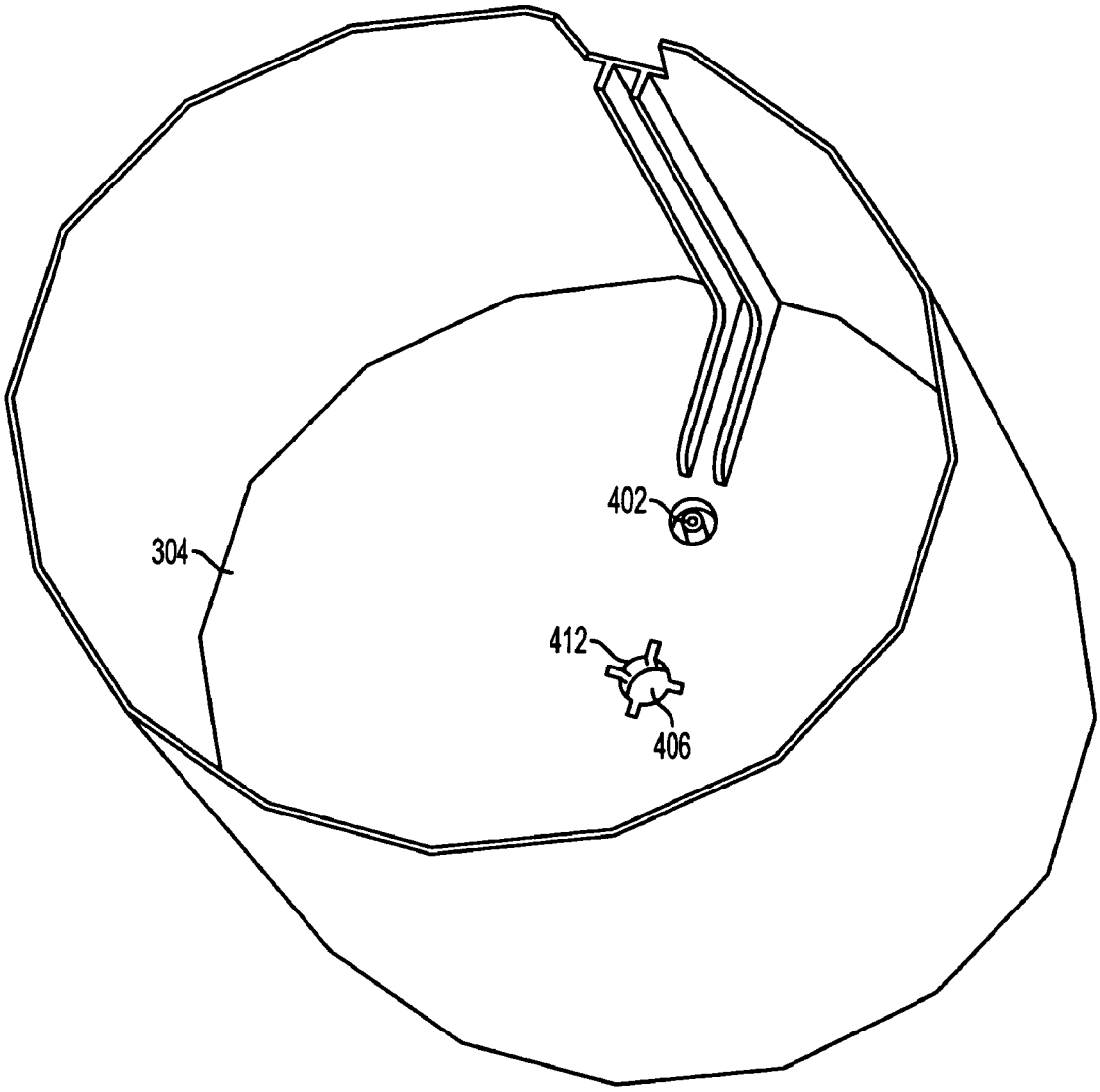
FIG. 3 is another perspective view of the support embodiment shown in FIG. 2, here without a top cover, a spike, or a vent tube.
Figure 4:
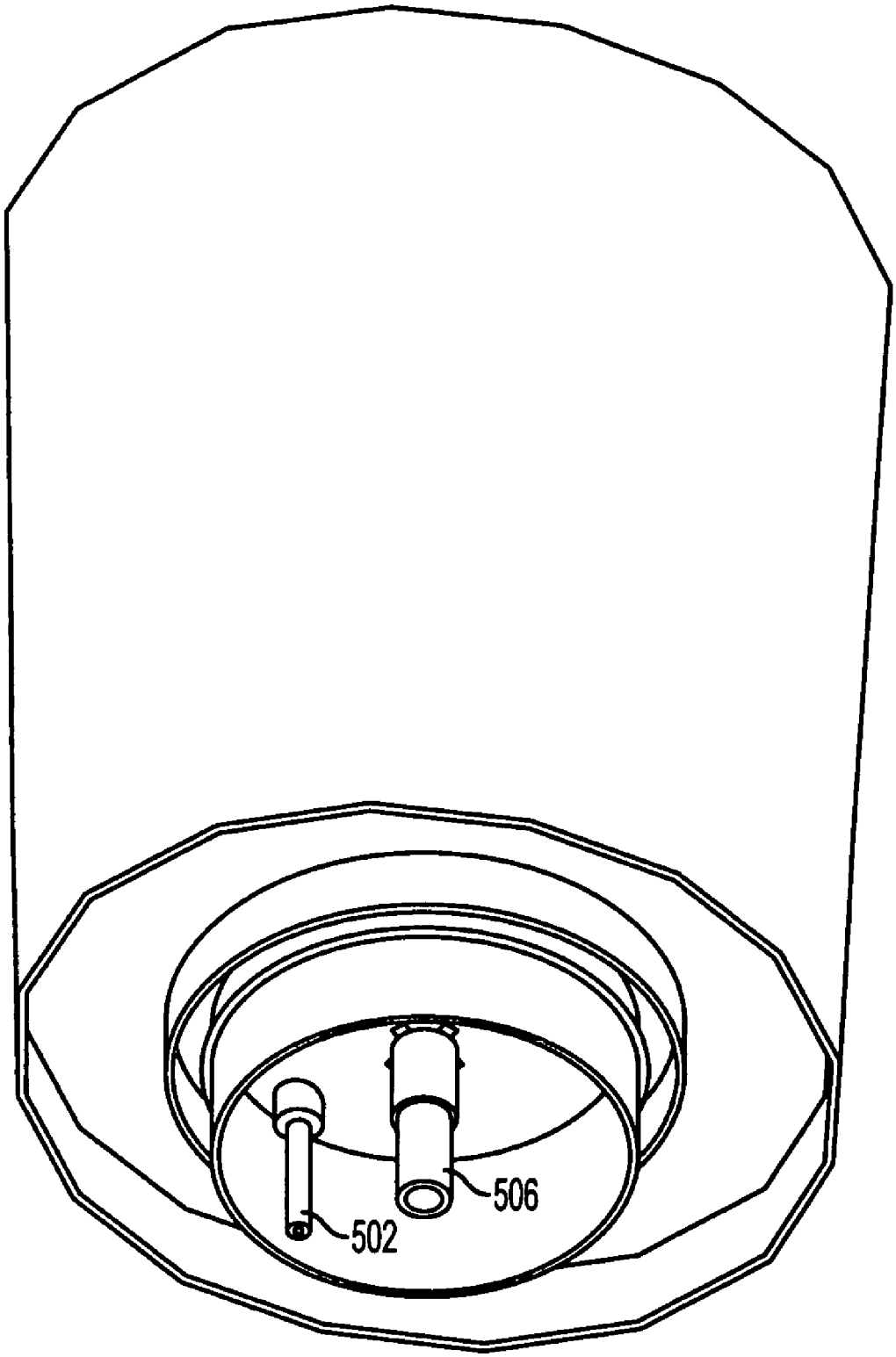
FIG. 4 is another perspective view of the support embodiment shown in FIG. 2, here showing the bottom exterior of the support.

FIGS. 2-4 show various views of a preferred embodiment of the support 206 and various elements connected thereto. This embodiment is generally cylindrical, having upright side walls 301, a removable top cover 302, and a bottom surface 304 that is fixed with respect to the side walls 301 and that slants toward a point that is a local minimum in elevation positioned near the geometric center of the bottom surface 304. As shown in FIG. 2, a spike 306 having an interior fluid passage is positioned at the point of local elevation minimum. In other embodiments the local minimum need not be near the geometric center of the bottom surface 304; it could be positioned off-center. As well, an alternate embodiment of the fluid dispensing system has a support 206 having more than one local minimum in the bottom surface 304, at each of which is placed a spike 306. In such an embodiment, the spikes may each feed fluid to a single chamber 202 or they may each feed separate chambers 202. It is not necessary, however, that the spike 306 be positioned at a local elevation minimum, though doing so is preferable as it aids in emptying fluid supported by the support 206, whether that fluid is contained within a bag 210 or not.

FIG. 3 shows a vent hole 402 that is connected to a channel traversing from one side to the other of the bottom surface 304 of the support 206. In a preferred embodiment, the vent hole is connected to a vent pipe 308 that runs up generally along the side wall 301 of the support 206. At some position along the length of the vent pipe 308, preferably near its highest elevation as shown here, the vent pipe 308 is attached to a filter 310 that filters any fluid moving through the vent pipe 308 and past the filter 310, and more importantly, fluids moving past the filter 310 and into the vent pipe 308.

Shown in FIG. 4, a vent extension 502 and spike extension 504 protrude from the bottom side of the support 206. These extension structures 502 and 504 provide extended fluid flow pathways for the vent pipe 308 and the spike 306, respectively, that extend into the chamber 202 when the support 206 is positioned on the cooler base 208, as shown in FIG. 1. In the preferred embodiment, the spike extension 504 extends further into the chamber than does the vent extension 502. Such a relationship between the lengths of the vent extension 502 and spike extension 504 leads to better operation of the dispenser system as described in more detail below.

As shown in FIGS. 2 and 3, and as can be deduced by comparing FIGS. 2 and 3 with FIGS. 4 and 5, in a preferred embodiment, the spike 306 is securely pressure fit into a hollow 406 at in the bottom of the support 206, and is additionally kept from rotating by the interaction of four generally perpendicularly projecting wing flairs 312 on the spike 306 with four slots 412 in the bottom surface 304 of the support 206 adjacent to the hollow 406. The press fit between the spike 306 and support 206 is preferably fluid tight. Each wing flair connects to the shaft 608 of the spike 306 along a length of the circumference thereof that is less than the length of the entire circumference. In alternate embodiments, the spike may be mated with the support 206 through the use of other methods including the use of threads that screw or bolt the spike 306 in position. When fit into the hollow 406 in the bottom surface 304, the spike 306 connects to the spike extension 506, which allows fluids to pass from an internal channel of the spike 306 to the chamber 202 (see FIG. 1). In an embodiment the spike extension 506 is comprised of more than one portion, the portions being repeatably separable so as to enable easy replacement of at least some portions thereof. In the preferred embodiment shown in FIGS. 2-5, spike extension 506 is a non-separable, molded portion of the support 206. In another embodiment, the spike 306 is long enough that the spike's fluid passage may be a substitute for this spike extension 506.

As will be further discussed below, fluid is dispensed from the bag 210 by first positioning the bag 210 on the support 206 and having the spike 216 puncture the bag 210. To prevent fluid loss between the bag 210 onto the supporting surface of the support 114 after the bag 210 is punctured, the bag 210 preferably seals about the spike 216. The spike 216, the preferred embodiment of which is shown in FIG. 5, includes a plurality of fluid inlets 602, which, after the puncturing of the bag 210 by the spike 306, allow fluid contained in the bag 210 to enter the fluid passage 604 within the spike 306. In a preferred embodiment, the fluid inlets 602 are positioned in the side wall of the conical tip 606 of the spike 306, though in alternate embodiments the fluid inlets 602 are positioned elsewhere on the spike, including on the shaft 608.

Upon the puncturing of a sealed bag 210 by the spike 216, the fluid path out of the chamber 202 through the spike 216 has become sealed relative to the ambient environment external to the cooler base 208. That is, after the puncturing of the bag 210, the only connection between the external environment and the chamber 202 is through the vent 218. The vent 218 then becomes the only passage through which to equalize the pressure between the chamber 202 and the external environment. Thus, if fluid flow into or out of the chamber 202 through the vent is appreciably slower than fluid flow into or out of the chamber 202 through either of the spike 216 or the tap 220, a pressure differential can develop between the chamber 202 and the external environment as fluid enters the chamber 202 from the bag 210 or exists the chamber 202 through the tap 220. In the embodiment shown in FIG. 1, such a differential in fluid flow rates exists, so that such a pressure differential may form.

After the bag 210 is punctured by the spike 216, the force of gravity pulls fluid through the spike 216 and into the chamber 202, and, assuming the tap 220 remains closed, some air is displaced from the chamber 202. The displaced air preferably travels out of the chamber 202 through the vent 218, since the exit path through the vent 218 presents less resistance to air travel than does a path through the spike 216 and into the bag 210. As fluid continues to flow from the bag 210 into the chamber 202, the level of fluid contained in the chamber 202 continues to rise, and air continues to be displaced through the vent 218, until the fluid level in the chamber 202 reaches the inlet to the vent 218. Once the fluid level in the chamber 202 reaches the inlet to the vent 218, no more air can be displaced out of the chamber 202. Thus, if the pressure in the chamber 202 is less than the pressure external to the bag 210, as fluid continues to flow into the chamber 202, the pressure in the chamber 202 begins to rise. Fluid flows into the chamber 202 and the pressure in the chamber 202 rises until the point where the pressure in the chamber 202 equals the ambient pressure external to the bag 210. Fluid from the bag 210 will flow into the chamber 202, and fluid from the chamber 202 will be pushed up into the vent 218, only until the fluid height in the vent 218 equals the height of the fluid in the bag 210. At this point, flow from the bag 210 into the chamber 202 will stop.

Now with fluid in the chamber 202, the same fluid can be dispensed through the tap 220. When the tap 220 is opened to allow fluid to be dispensed from the chamber 202, the water level in the chamber 202 decreases, until eventually the fluid level in the chamber 202 is lower than the inlet of the vent 218. During dispensing, the pressure in the chamber 202 is reduced from the value at equilibrium (no flow), thus allowing fluid to begin again to flow from the bag 210 into the chamber 202. So long as the volume fluid flow through the spike 216 is less than the volume fluid flow through the tap, the fluid level in the chamber 202 continues to decrease as the fluid continues to be dispensed. As well, so long as the pressure in the chamber 202 is less than the pressure external to the bag 210, fluid in the vent 218 will be forced back into the chamber 202, until, at some point, all the fluid from the vent 218 will have been forced back into the chamber 202, and air from external to the cooler base 208 will begin to flow into the chamber 202 through the vent 218. Air flow into the chamber 202 through the vent 218 will continue until the pressure in the chamber is equal to the ambient pressure external to the bag 210. So long as the volume rate of flow out of the tap 220 (i.e., out of the chamber 202) is greater than the combined volume rate of flow into the chamber 202 through the spike 216 and the vent 218, the pressure in the chamber 202 will continue to decrease.

When the tap 220 is finally closed, the reduced pressure in the chamber 202 will add to the total force working to move fluid from the bag 210 into the chamber 202. Not only will gravity be pulling the fluid through the spike 216, but also pressure external to the bag 210 will be pushing the fluid through the spike 216 into the chamber 202. Such a chamber 202 in which pressure is reduced during dispensing is beneficial to the evacuation of fluid from the bag 210 to the greatest extent, since, in effect, the reduced pressure in the chamber 202 results in a greater net force working to push fluid out of the bag 210. As stated above, these forces will work to move fluid from the bag 210 into the chamber 202 (at the same time atmospheric pressure is pushing air into the chamber 202 through the vent 218) until all forces are equilibrated, wherein the fluid will have risen in the vent 218 to a height equal to the height of the fluid in the bag 210.

The bottom of the vent extension 502 is preferably higher in the chamber than is the bottom of the spike extension 506. Generally, the lower the height of the inlet to the vent 218 (i.e., the bottom of the vent extension 502) relative to the bottom of the chamber 202, there is less time for the pressure in the chamber 202 to equilibrate with ambient pressure external to the bag 210 prior to the water level in the chamber 202 reaching the inlet to the vent 218. If the volume fluid flow into the chamber 202 through the spike is greater than the combined volume fluid flow out of the chamber 202 through both the tap 220 and the vent 218, there will be an increase in pressure in the chamber 202, which can increase above the pressure external to the bag 210. An increase in pressure is more likely to happen with a longer vent extension 502, since there is less time for the pressure to equilibrate before the fluid level in the chamber 202 reaches the bottom of the vent extension 502. If the pressure in the chamber 202 is greater than the ambient pressure external to the bag 210 when the water level in the chamber 202 reaches the inlet to the vent 218, the fluid in the vent 218 is likely to be pushed up into the vent 218 to a level above the level of the fluid in the bag 210 and, then, may erupt from the top of the vent 218, which is an undesirable event.

In a preferred embodiment the the dimensions of the components of the fluid dispensing system 200, particularly those of the chamber 202, the fluid passage 604 of the spike 216 and spike extension 506, and the vent 218 and vent extension 502, are such that while a pressure reduced below the pressure external to the bag 210 may form in the chamber 202 during dispensing, no increase in pressure above the pressure external to the bag 210 will form while the chamber 202 is being refilled from the bag 210.

Additionally, in a preferred embodiment, the dimensions of the components of the fluid dispensing system 200, particularly those of the chamber 202, the fluid passage 604 of the spike 216 and spike extension 506, and the vent 218 and vent extension 502, are such that there is no piston action that shoots water out of the top of the vent 218 upon the puncturing of the bag 210 with the spike 216. In a case where a new bag 210 full of fluid is punctured by the spike 216, it is possible that there will be a transient increase in pressure in the chamber 202, especially if the bag 210 is dropped onto the spike 216, as in the preferred embodiment discussed above. In the event there is such a transient pressure increase in the chamber 202, it is preferable that the vent channel 218 not have retained fluid, such as may occur when the vent channel is small enough that the fluid surface tension is sufficient to maintain fluid in the vent 218. Additionally, it is preferable that sufficient air remains in the vent channel between any retained fluid and the top of the vent 218 or the filter 310, since this air can act as a cushion to absorb the shock of any transient pressure increase, thereby preventing fluid from being pushed out the top of the vent.

As is known to one of ordinary skill in the art, the chamber 202 may be heated or cooled through the use of various methods, and a dispensing system 200 may even comprise more than one chamber 202, in which case, for example, a first chamber 202 can be cooled and a second chamber 202 heated to provide both cooled and heated fluid from the same fluid dispensing system 200.

A fluid dispenser of the present invention can be fabricated new, or portions thereof can be manufactured to retrofit other existing portions thereof in order to construct a complete embodiment of the present invention. Particularly, a support 206 can be manufactured to fit with an existing cooler base 208 having a chamber 202. Where a support 206 is manufactured to retrofit an existing cooler base 208, the design of the support 206 may take account of and incorporate the use of various components of the existing cooler base 208, or other components of an existing dispensing system attached thereto, such as, for example, any portions designed to isolate the chamber 202 from external environmental influences.

Figure 6:
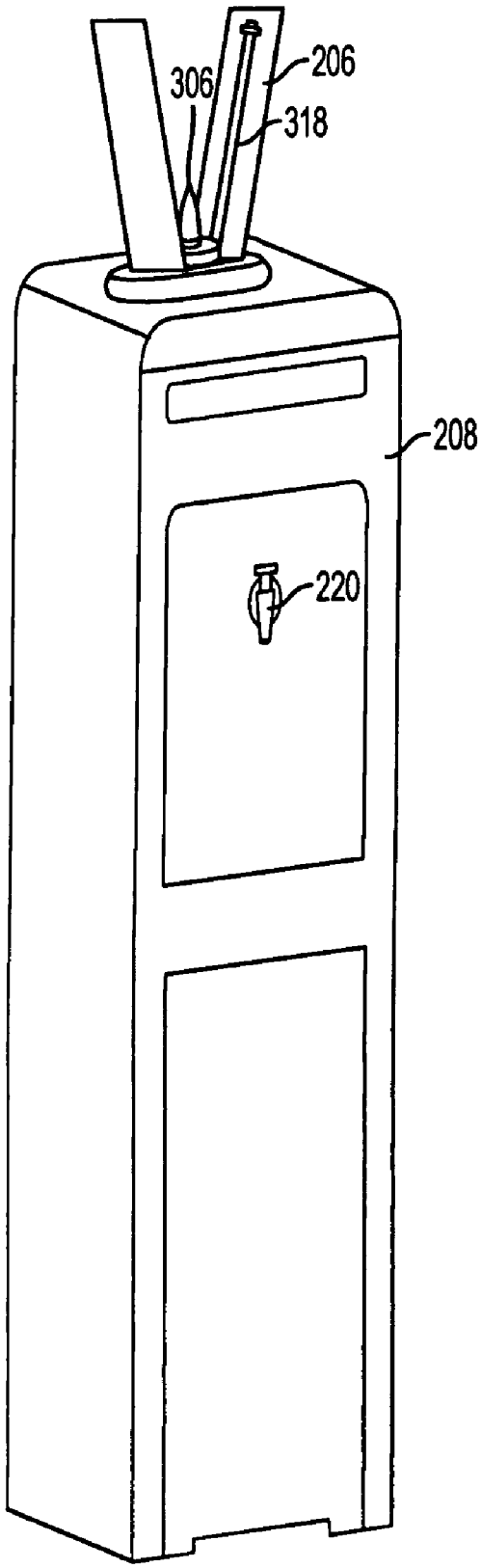
FIG. 6 is an exterior perspective view of another embodiment of a fluid dispensing system of the present invention in which the support does not provide an enclosed space for supporting a bag containing fluid.

As noted above, since an important function of the support 206 with respect to the bag 210 is merely to support the bag 210 while fluid is being drained from the bag 210, the support 206 may adopt various shapes suitable for accomplishing this function without departing from the scope of the invention. FIGS. 2-5 show an embodiment of the support 206 that is generally cylindrically shaped. Another example is illustrated in FIG. 6, which shows the support being essentially V-shaped, having two, converging, planar sides. Other possible shapes for the support are discussed or shown in Provisional Patent Application No. 60/502,723, filed Sep. 12, 2003, including a single, level plane and a surface in which such a level plane has been uniformly curved along one dimension. In an embodiment, the support 206 includes a cover 302 positioned at the top of the support 206, which cover 302 may provide further protection against contamination of any fluid to be dispensed from the cooler.

While the invention has been disclosed in connection with certain preferred embodiments, the elements, connections, and dimensions of the preferred embodiments should not be understood as limitations on all embodiments. Modifications and variations of the described embodiments may be made without departing from the spirit and scope of the invention, and other embodiments should be understood to be encompassed in the present disclosure as would be understood by those of ordinary skill in the art.

The invention claimed is:

1. A fluid dispensing system comprising:
- a dispensing base;
- a chamber positioned interior to said base, and having a space therein;
- a bag containing fluid;
- a support means supporting said bag containing fluid, said support means including:
  - a means for allowing said fluid in said bag to flow into said chamber, said means for allowing said fluid to flow comprising a spike;
  - a means for allowing the venting of pressure in said chamber to a space external to said enclosed chamber; and
  - a means for otherwise separating said space in said chamber from said space external to said support;
  - wherein and support means is repeatedly separable from said dispensing base; and
- a means for dispensing fluid from said chamber to a space external to said dispensing base.

2. The fluid dispensing system of claim 1 wherein said spike further comprises at least one wing flair.

3. The fluid dispensing system of claim 1 further comprising a protective outer layer enclosing said bag containing fluid, wherein after said protective outer layer has been removed from around said bag, said bag will seal around said spike when said bag is punctured by said spike.

4. A fluid dispensing system comprising:
- a dispensing base;
- a chamber positioned interior to said dispensing base, and having a space therein;
- a bag containing fluid;
- a support connected to said dispensing base via a gasket, said support including:
  - a fluid passage; and
  - a vent;
  - wherein, said support supports said bag containing fluid;
  - wherein said fluid passage allows said fluid in said bag to flow into said chamber;
  - wherein said vent connects said chamber to a space external to said enclosed chamber; and
  - wherein said support otherwise separates said space in said chamber from said space external to said support; and
- a dispensing valve connected to said enclosed chamber allowing for dispensing from said enclosed chamber.

5. The fluid dispensing system according to claim 4, wherein said support is fabricated from a plastic resin material.

6. The fluid dispensing system according to claim 4, wherein said fluid passage further comprises a spike.

7. The fluid dispensing system according to claim 6, wherein said spike is positioned in said support adjacent a point of local elevation minimum thereof.

8. The fluid dispensing system according to claim 6, wherein said spike comprises a conical tip having at least one fluid inlet positioned on said tip.

9. The fluid dispensing system according to claim 8, wherein said spike further comprises a shaft having at least one generally perpendicularly projecting wing flair.

10. The fluid dispensing system according to claim 9, wherein said at least one wing flair connects to the shaft of the spike along a length of the circumference thereof that is less than the length of the entire circumference.

11. The fluid dispensing system according to claim 6, wherein said bag containing fluid is essentially sealed about said spike, said spike having punctured a wall of said bag.

12. The fluid dispensing system according to claim 11 wherein said bag is fabricated from a single-layer polyethylene sheet.

13. The fluid dispensing system of claim 12 wherein prior to the puncturing of said bag by said spike, a protective outer layer enclosing said bag is removed from about said bag.

14. The fluid dispensing system according to claim 4, wherein said chamber includes a means for altering the temperature of the fluid contained therein.

15. The fluid dispensing system according to claim 4 wherein the maximum volume rate of fluid flow through said vent into said chamber is limited to a value less than the maximum net volume rate of fluid flow out of the chamber through said dispensing valve taking into account the maximum volume rate of fluid flow into said chamber through said fluid passage from said bag, so that as fluid is dispensed out from said chamber through said valve at said maximum net volume rate of flow, the pressure in said chamber is reduced below the pressure external to said fluid dispensing system at the location of the end of said vent opposite from the end of said vent located in said chamber.

16. The fluid dispensing system according to claim 4, wherein when said dispensing valve is closed, said fluid in said bag will flow though said fluid passage into said enclosed chamber and into said vent, until the fluid level in said vent is the same as the fluid level in said bag.

17. A fluid dispensing system for dispensing fluid from a collapsible bag, comprising:

a support being capable of supporting said collapsible bag during dispensing of fluid from said bag and having a supporting surface that includes a point on said surface that can be oriented as a local minimum in elevation, said supporting surface separating a first space adjacent to a first side of said supporting surface from a second space on a second side of said supporting surface, opposite said first side;

a spike connected to said support projecting essentially from said point on said surface and projecting into said first space and said second space, said spike including a fluid inlet on the exterior surface of said spike, said fluid inlet being connected to a passage internal to said spike through which fluid can flow after passing through said inlet, said passage connecting from within said first space into said second space;

a collapsible bag containing fluid into which said spike projects, said spike providing access for said fluid in said bag to said second space; and a vent pipe extending into said first space and into said second space through which said fluid can pass;

wherein when said fluid dispensing system is in use, said first space is sealed from said second space such that said first space and said second space are in fluid communication only through said passage and said vent pipe.

18. The fluid dispensing system according to claim 17 wherein said vent pipe is dimensioned so that no portion of said fluid is entrained within said vent as a result of the surface tension of said fluid.

19. The fluid dispensing system according to claim 17 wherein said second space, said spike, and said vent pipe are dimensioned so that when said collapsible bag is punctured by said spike, any increase in pressure in said second space resulting therefrom is absorbed by compressible gasses in said second space and in said vent pipe, and does not result in fluid being ejected from said vent pipe into said first space.

20. The fluid dispensing system of claim 17 wherein prior to said spike projecting into said bag, a protective outer layer is removed from about said bag.

* * * * *